US005502881A

United States Patent [19]

Gaydoul

[11] Patent Number: 5,502,881

[45] Date of Patent: Apr. 2, 1996

[54] APPARATUS FOR DESCALING SUBSTANTIALLY FLAT SURFACES OF HOT ROLLED STOCK

[76] Inventor: Jürgen Gaydoul, Lansenvägen 3, 183 65 Täby (Stockholm), Sweden

[21] Appl. No.: 260,521

[22] Filed: Jun. 16, 1994

[30] Foreign Application Priority Data

Aug. 23, 1993 [DE] Germany ..... 43 28 303.9

[51] Int. Cl.[6] ..... B21B 45/04

[52] U.S. Cl. ..... 29/81.08; 72/40; 134/122 R; 134/172

[58] Field of Search ..... 29/81.05, 81.06, 29/81.08, 81.09; 72/39, 40; 134/15, 34, 122 R, 172, 198, 199

[56] References Cited

U.S. PATENT DOCUMENTS

| | | | |
|---|---|---|---|
| 3,510,065 | 5/1970 | Gigantino et al. . | |
| 3,811,305 | 5/1974 | Saylor . | |
| 4,537,639 | 8/1985 | Shook . | |
| 5,028,004 | 7/1991 | Hammelmann | 134/176 X |
| 5,220,935 | 6/1993 | Bailey et al. | 134/122 R |
| 5,296,038 | 3/1994 | Faxon | 134/172 X |

FOREIGN PATENT DOCUMENTS

| | | | |
|---|---|---|---|
| 0047731 | 8/1981 | European Pat. Off. . | |
| 0197502 | 4/1986 | European Pat. Off. . | |
| 526440 | 2/1993 | European Pat. Off. | 29/81.08 |
| 1290112 | 6/1963 | Germany . | |
| 2901896 | 11/1983 | Germany . | |
| 63-68213 | 3/1988 | Japan | 72/39 |
| 8900012 | 8/1990 | Netherlands | 29/81.08 |
| 1252150 | 8/1986 | U.S.S.R. | 134/122 R |

*Primary Examiner*—S. Thomas Hughes
*Attorney, Agent, or Firm*—John C. Thompson

[57] ABSTRACT

Apparatus for removing surface layers from workpieces, especially for descaling hot rolled stock moved with respect to the apparatus, by spraying highly pressurized fluid, especially pressurized water on both sides of the rolled stock from rows of nozzles extending across the workpiece width and each including a plurality of nozzle heads is characterized in that the nozzle heads rotate and each nozzle head comprises at least one nozzle, preferably a plurality of nozzles uniformly distributed around its circumference. The number of nozzles, the rotary speed of the nozzle heads, and the speed of relative motion between the rolled stock and the apparatus are tuned such that desired average intensity and depth of removal are obtained.

3 Claims, 6 Drawing Sheets

APPARATUS FOR DESCALING SUBSTANTIALLY FLAT SURFACES OF HOT ROLLED STOCK

The invention relates to a means for descaling hot rolled stock which is moved with respect to the means, by spraying highly pressurized fluid, especially pressurized water on both sides of the rolled stock from rows of nozzles extending across the width of the rolled stock and each comprising a plurality of nozzle heads.

It is known to descale hot rolled stock, especially thin rolled steel by subjecting it to spraying with pressure water on both sides (DE 29 01 896 C2).

FIG. 1 shows the arrangement of similar descaling means in the roughing mill section of a rolling mill for producing wide steel strip. Reference numeral 1 designates an annealing furnace for annealing the material which is to be rolled, reference numeral 2 designates a vertical roughing mill, reference numeral 3 designates a horizontal roughing mill, while reference numeral 4 designates another vertical roughing mill. Descalers 5 are positioned between the individual rolling mills 2, 3, 4 to spray pressure water on both sides of the rolled stock so as to remove scale layers from the lower and upper surfaces of the rolled stock 7 which is being moved in the direction of arrow F on a roller train comprising driven rollers 6.

FIG. 2 illustrates the known descaler 5 in greater detail. As shown, pressure water pipes 8 comprising rows of nozzles 9 directed against the opposed surfaces of the rolled stock 7 extend transversely of the longitudinal extension or direction of movement F of the rolled stock 7. The nozzles 9 are designed as flat section jet nozzles whose jet pattern 10 corresponds to a flattened ellipse. All the nozzles are oriented such that the great main axis of this flattened ellipse of the jet pattern 10 likewise extends transversely of the longitudinal extension or direction of movement of the rolled stock 7 so that all the surface areas of the rolled stocked being conveyed between the rows of nozzles 9 are descaled by the flat section jet nozzles.

The pressure water is supplied by centrifugal pumps 13 which are driven by motors 14. The centrifugal pumps 13 feed a pressure water reservoir 16 through check valves 15, the pressure water reservoir 16 supplying pressure water to a manifold 11 through a valve 17 which can be closed. In this manner the pressure water pipes 8 receive pressure water upon demand. Typical operating conditions are a rolled stock width of 900 mm, speed of motion of the rolled stock in the direction of arrow F of 1 m/s, and a flow rate through the nozzles 9 of 12000 l/min.

Descaling by the known descaler as presented in FIG. 2 leaves something to be desired. On the one hand, the depth of removal is not sufficient to really take away all the scale (including the invisible scale). Moreover, scale which has chipped off due to the spraying with pressure water may fall back on the surface of the rolled stock and then be rolled into the surface once more during the next pass. Finally, the huge volume of the pressure water stream or its high flow rate may cause undesirable cooling of the rolled stock, thus rendering the subsequent passes in the rolling process more difficult.

It is the object of the invention to provide a means for descaling hot rolled stock moved past the descaler spraying highly pressurized fluid, especially high pressure water, on both sides of the rolled stock from rows of nozzles (8) which extends across the workpiece width, each including a plurality of nozzle heads (20) wherein the uniformity of the surface treatment and the depth of removal can be increased and a better surface quality of the treated surfaces of the rolled stock can be obtained in descaling hot rolled stock.

To meet this object, it is provided according to the invention that each nozzle head rotates about an axis of rotation substantially at right angles to the surface of the rolled stock and comprises at least one nozzle which is disposed eccentrically with respect to the axis of rotation.

Advantageously, a plurality of nozzles are arranged at uniform spacings around the periphery of each nozzle head. In a preferred embodiment a total of four nozzles are mutually offset by 90° around the periphery of the nozzle head so as to achieve better uniformity in the surface treatment. The intensity and uniformity of the surface treatment depend on the fact that surface areas are exposed several times to the pressure fluid. Apart from the fundamentally set distance of the nozzle heads from the surface of the rolled stock, this is accomplished not only by the number of nozzles per nozzle head but also by the harmonization between the rotary speed of the nozzle heads and the relative speed of motion of the workpiece (rolled stock).

Advantageously, the rotary speed is selected in the range of from 200 to 1000 rpm and the relative speed of motion in the range of from 0.1 to 1.5 m/s. In experiments, a speed of rotation of about 1000 rpm and a relative speed of motion of about 0.8 m/s have proved to be especially beneficial.

In practice the diameter of the nozzle heads is between 1 and 500 mm, preferably between 100 and 200 mm. As in the prior art, the nozzles may be embodied by flat section jet nozzles or they may be round section jet nozzles producing round spray patterns.

Preferably, means are provided to discharge or hold back chipped off surface particles from the surfaces which have undergone treatment. To make sure, for instance, that particles of scale split off from the surface are washed away, another advantageous embodiment of the invention provides for the spray axis of at least one nozzle of the nozzle head to be adjustable at an angle of up to 30° with respect to the axis of rotation of the nozzle head which axis is perpendicular to the surface. Trough arrangements likewise may be provided to collect split off scale particles.

The nozzles should be oriented as closely as possible to the vertical with respect to the workpiece surface whenever particularly intensive treatment of the surface is desired.

Another advantageous embodiment of the invention is characterized in that the row of nozzles acting upon the top surface of the rolled stock is offset in the direction of motion of the rolled stock with respect to the row of nozzles acting upon the underside. This disposition makes sure that unintentional spraying cannot damage the respective opposed row of nozzles if no rolled stock should happen to be located between the rows of nozzles disposed at either side thereof. It is not absolutely required that the rows of nozzles be arranged transversely of the rolled stock; a person skilled in the art can provide any other arrangement which seems suitable to him, for example, oppositely oblique arrangements (see DE 29 01 896 C2).

Furthermore, it can be assured that surface particles which have broken away under the pressure fluid treatment are caught in trough arrangements before falling back on the surface.

Another embodiment of the invention is aimed at achieving uniformly great removal in the inner section of the spray pattern. To this end, at least two nozzles advantageously are arranged differently, preferably so as to be offset both in circumferential direction and in radial direction such that their respective spray patterns cover different radial areas of the rolled stock. The uniform descaling obtained across the entire surface area subjected to spraying makes this embodiment of the invention especially well suited for use in descaling thin sheets or plates, such as produced in continuous casting. Moreover, this embodiment is characterized by particularly low water consumption.

A means devised according to the invention can do with much lower flow rates (about ¼ of the conventional flow) thanks to the very high pressure fluid pressures applied (in the order of magnitude of 1000 bar) and thus also thanks to the greater spraying intensity and the substantially increased volumetric pump efficiency (96%). This, at the same time, reduces the undesired cooling effect.

The invention will be described further, by way of example, with reference to the accompanying drawings, in which.

Figure 1:
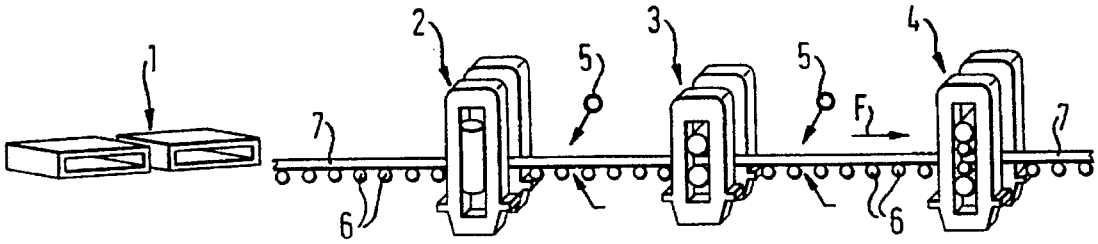
Fig. 1 (prior art)
FIG. 1 shows a prior art arrangement of descaling apparatus in the roughing mill section of a rolling mill for producing wide steel strip.
Figure 2:
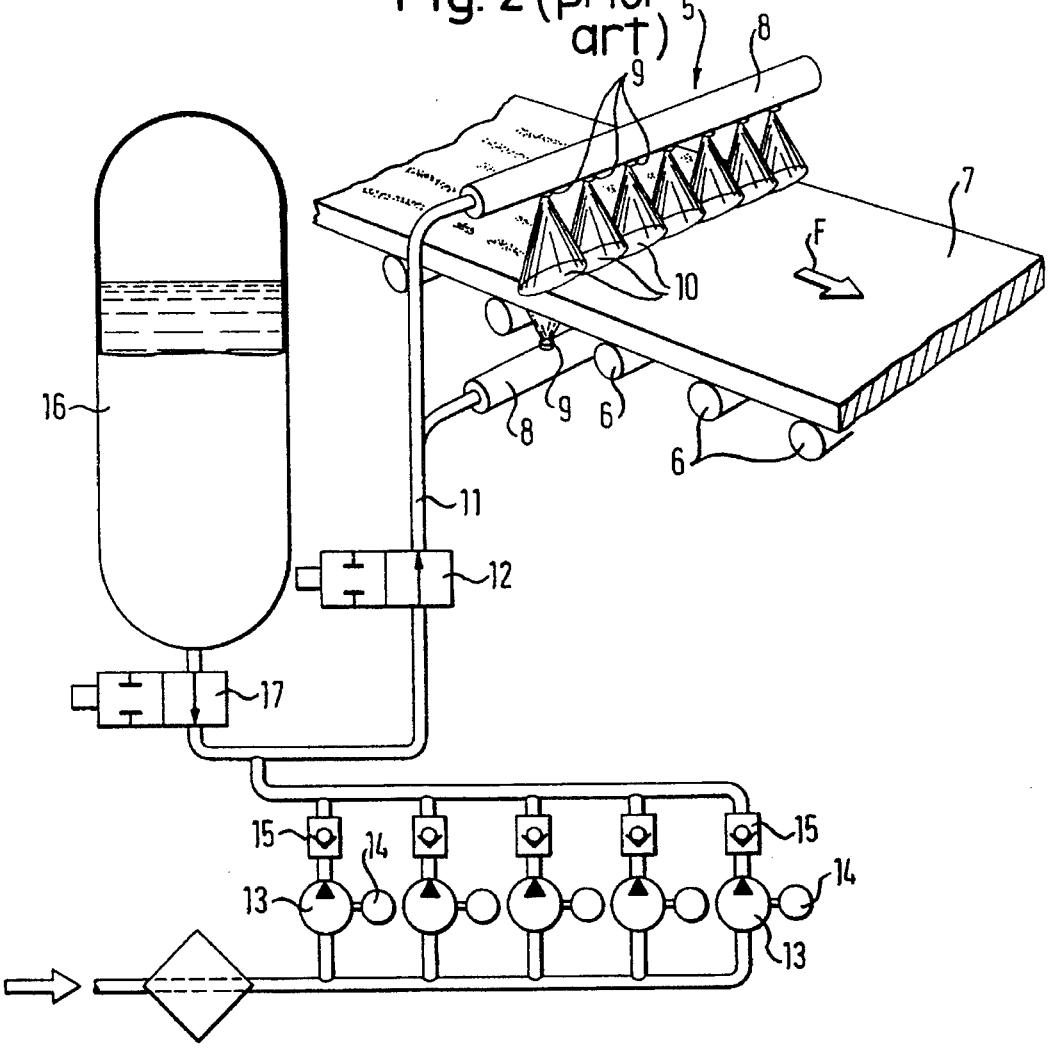
Fig. 2 (prior art)
FIG. 2 illustrates the prior art descalers in greater detail.

Parts in FIGS. 3 to 11 which are like those in FIGS. 1 and 2 are designated by the same reference numerals.

Figure 3:
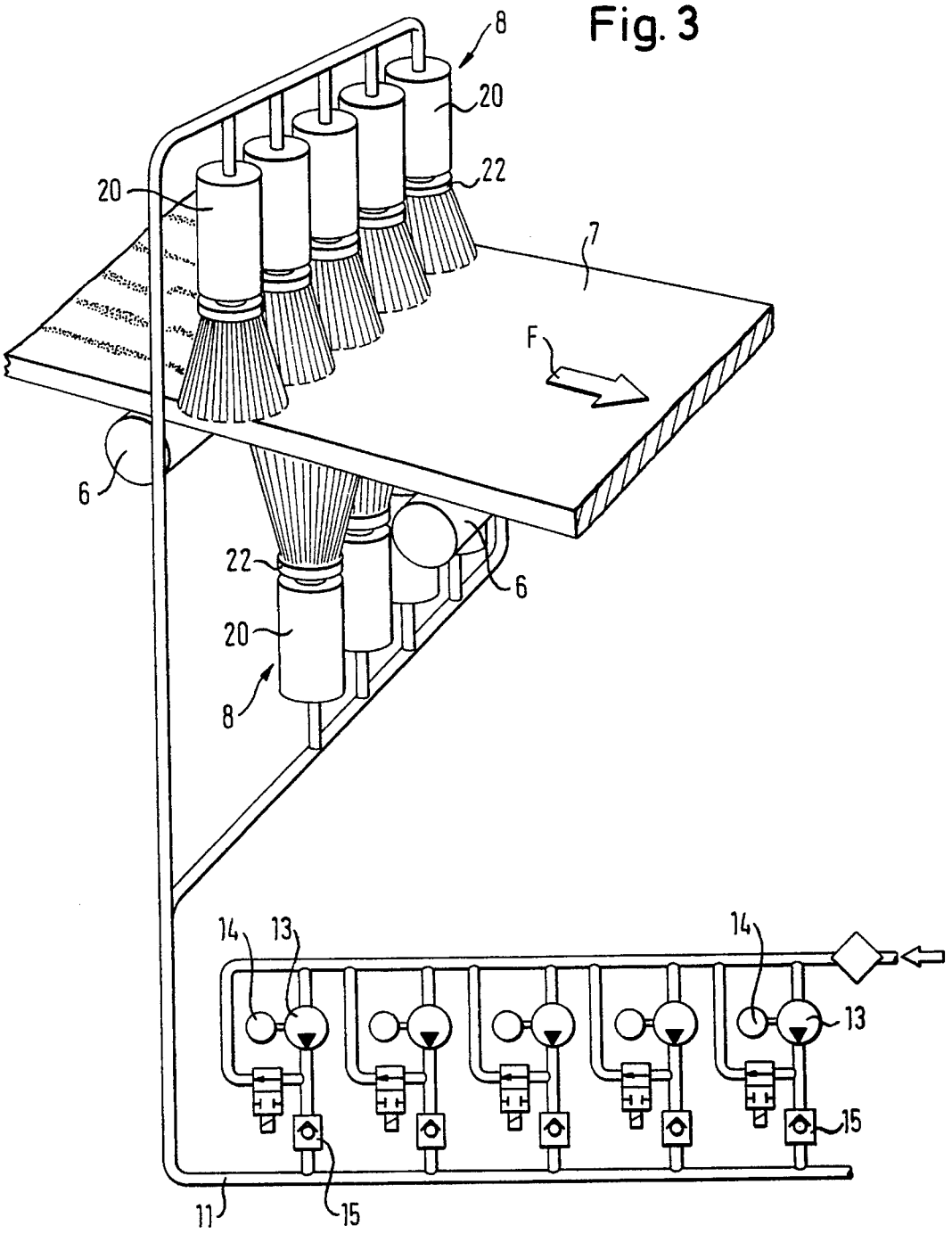
FIG. 3 is a perspective view of a means for descaling rolled stock according to the invention.
Figure 4:
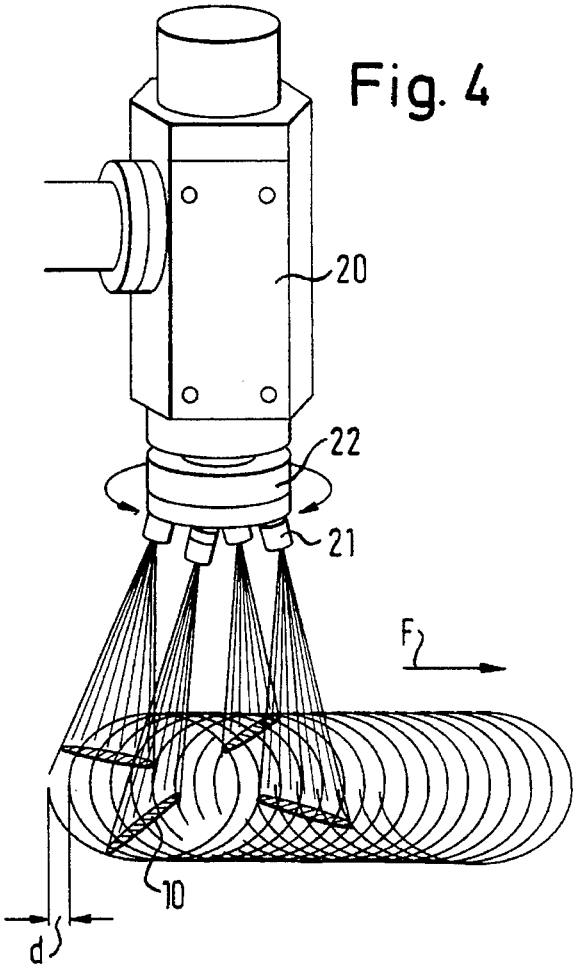
FIG. 4 is a perspective view of a nozzle head of the descaler shown in FIG. 3, including a schematic presentation of the overall spray pattern generated by rotation of the nozzle head as well as "instantaneous pictures" of individual spray patterns of the various nozzles of the spray head.
Figure 6:
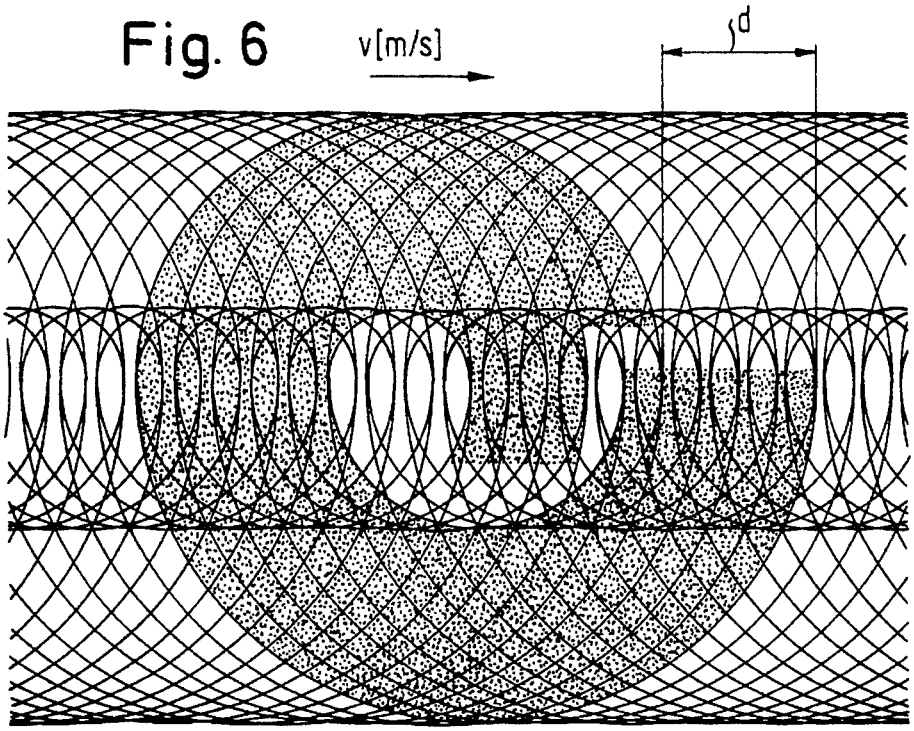
FIG. 6 is a top plan view of a spray pattern produced by a nozzle head according to the invention, the spiral path swept by the nozzle head during one rotation being shown in darker shade.

The means illustrated in FIG. 3 comprises two rows 8 of five nozzle heads 20 each, one thereof being illustrated in detail in FIGS. 4 and 6. Each nozzle head 20 comprises nozzles uniformly distributed around its circumference, this being four flat section jet nozzles 21 offset by 90° in the embodiment shown. The flat section jet nozzles 21 are mounted on a ring 22 adapted to be driven in rotation and to be supplied with pressure water through a common ring duct 23.

The pressure water supply to the nozzles through a common manifold 11 is similar to FIG. 2. However, a pressure water reservoir 16 and a magnetic valve 17 can be dispensed with due to the higher water pressures (around 1000 bar).

Figure 9:
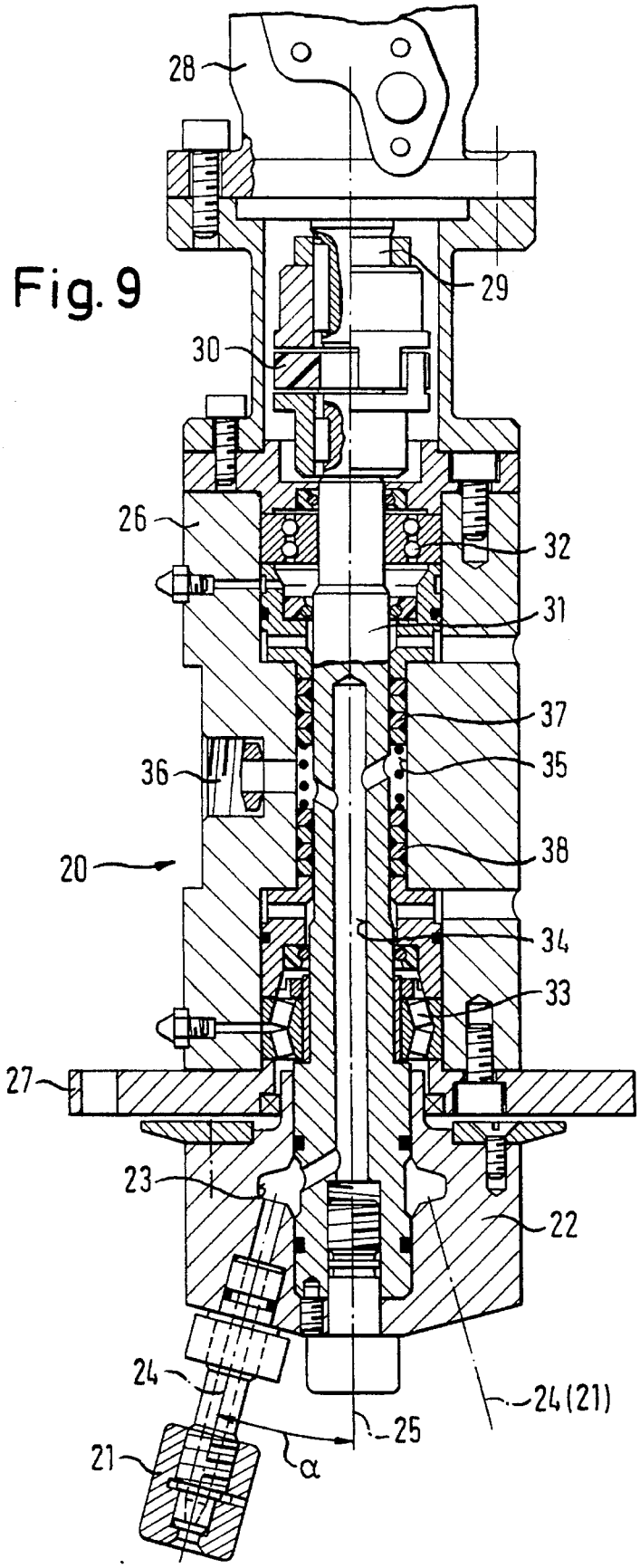
FIG. 9 is a sectional elevation of a concrete design of a nozzle head according to the invention.

The structure of a nozzle head according to the invention will be explained in detail with reference to FIG. 9. In FIG. 9 only one flat section jet nozzle 21 is shown with its spray axis 24 inclined at an angle $\alpha$ with respect to the axis of rotation 25 of the nozzle head 20, which axis is at right angles to the surface. This angle is advantageous, at least for one nozzle 21 per spray head 20, being adjustable between 0° and 30° with respect to the axis of rotation 25.

The nozzle head 20 includes a stationary housing member 26 held by means of a flange 27 of a stationary retainer member (not shown) which is common to all nozzle heads 20. The end of the nozzle head 20 remote from the workpiece is flange connected to a motor designated 28 whose driven shaft 29 is connected by a clutch 30, which is of conventional design and flexible in circumferential direction, to the drive shaft 31 of the rotary ring 22 provided with the nozzles 21.

The drive shaft 31 is supported by roller bearings 32, 33 in the housing 26. It is formed with a central bore 34 for supply of pressure water to the nozzles 21, this pressure water being fed through an annular duct 35 and a transverse bore 36 in the housing 26. The annular duct 35 is sealed pressure tight by means of two packings 37, 38, and the pressure water connecting element (not shown) which is to be threaded into the transverse bore 36 likewise is designed to be pressure tight against the extremely high pressures.

Figure 5:
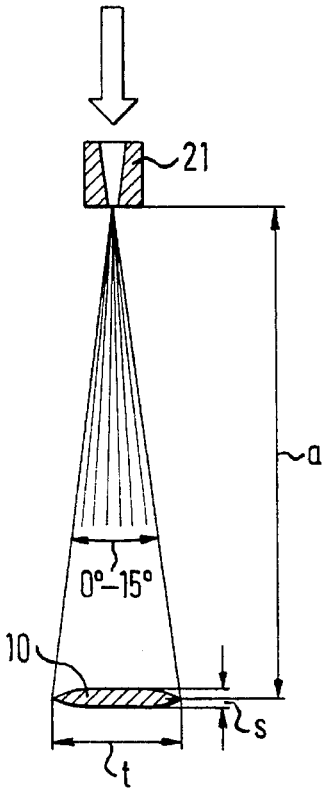
FIG. 5 is another schematic illustration of the spray pattern and corresponding spray angle obtained from a single nozzle of the nozzle head shown in FIG. 4.

Operation will now be explained with reference to FIGS. 4 and 5. The nozzle heads 20 are arranged opposite the surface to be treated in such manner that a distance a exists between the nozzles 21 and the surface. This distance is selected such that the length t of the great main axis and the length s of the small axis of the elliptical spray pattern correspond to desired values. The angle of aperture in the direction of the great main axis t of the flat section jet nozzle 21 preferably is between 0° and 15°. This angle is half as big as in the case of the prior art (cf. FIG. 2) where a wide angle is needed in order to cover the full width of the rolled stock while avoiding too great a number of nozzles.

FIGS. 4 and 6 illustrate the effect of treatment with a nozzle head 20 according to the invention. The flattened ellipse 10 of the spray pattern rotates about the vertical axis of the nozzle head 20 due to the rotation of the nozzles 21 while the workpiece is being moved on below the nozzle heads 20 in the direction of arrow F. When the speed of rotation r of the nozzle head 20 is selected to be 1000 rpm and the speed of motion v of the rolled stock 7 with respect to the stationary nozzle heads 20 is selected to be 0.8 m/s, the rolled stock 7 is advanced by distance d during one revolution of the nozzle head 20. This distance d corresponds to ¼ to ⅕ of the nozzle head radius.

This results in a spiral spray pattern, as shown particularly in FIG. 6 by the dark spiral configuration corresponding to one nozzle head rotation of 360° as the rolled stock 7 advances by distance d. As FIG. 6 clearly demonstrates, uninterrupted descaling of the rolled stock surface across the full width of the rolled stock is guaranteed by the design according to the invention. And all the surface areas are swept, and therefore treated, several times in response to the rotary speed of the nozzle heads chosen, the number of nozzles installed, and the speed at which the rolled stock advances. This effect can be varied by the choice of the rotary speed of the nozzle heads 20 as well as the speed of motion of the rolled stock 7 by stepwise adjustment of the drive rotation of the rollers 6 in accordance with any particular conditions given and the desired depth of removal.

The pressures applied of the pressure water are much higher than in the prior art. They may be adjusted in the order of magnitude of 1000 bar. In view of the existing relationship: impact pulse=pressure×rate of flow, this permits the flow rate of pressure water during unit time to be reduced substantially, causing a corresponding substantial reduction of the cooling effect (which is undesired for rolling). In the concrete structure according to FIGS. 7 and 8 the upper row of nozzles with the nozzle heads 20 is retained in a stationary housing 40, while the lower row of nozzles is retained in a stationary housing 50. Both housings 40, 50 extend transversely of the roller path provided for the workpieces 7.

Figure 7:
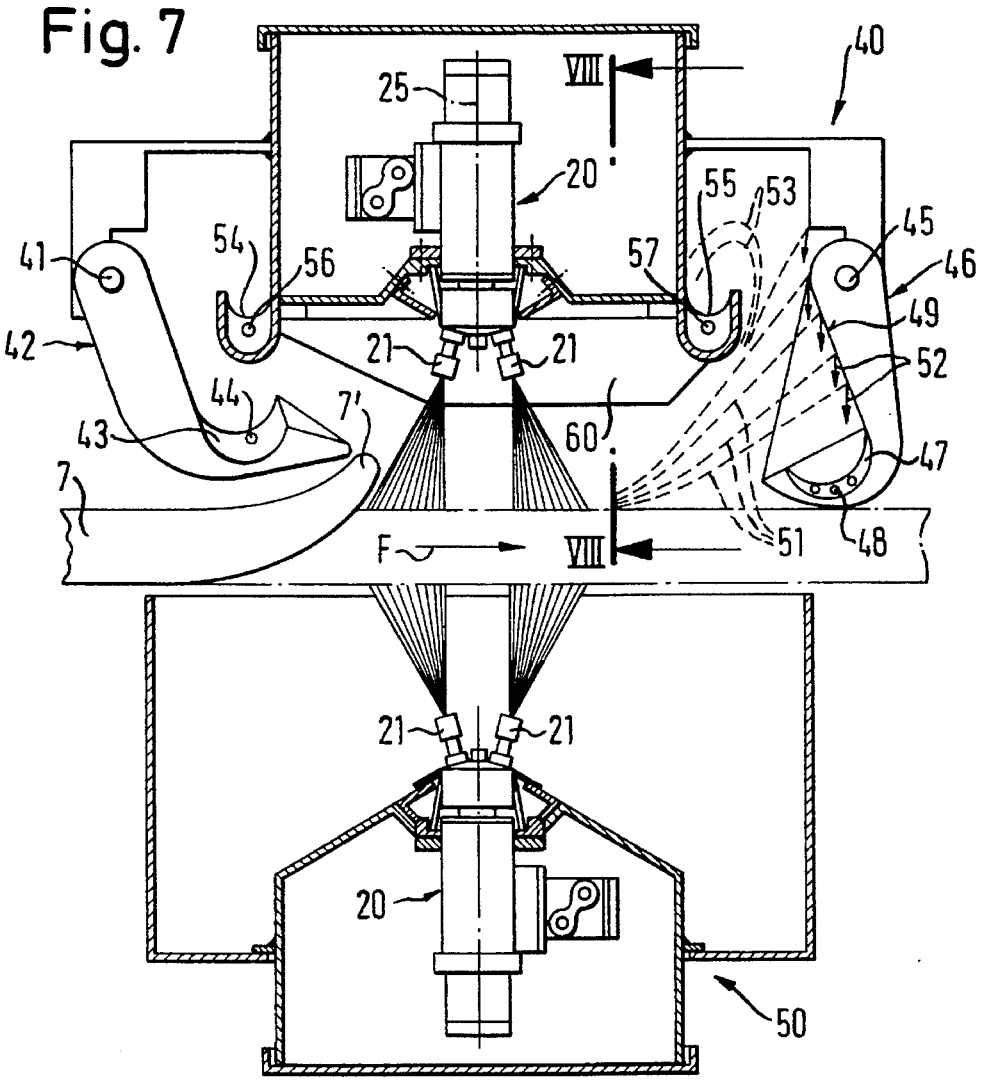
FIG. 7 is a side elevation of an actual structure of a means built according to the invention.

The axes of the nozzles 21 each are inclined at approximately 15° with respect to the vertical nozzle head axis 25. A trough arrangement 42 which is hook-shaped in cross section and formed with a depression 43 for split off or chipped off scale particles is mounted at the inlet side of the upper housing 40. The trough arrangement 42 is pivotable in counterclockwise sense about a horizontal pivot axis 41 and extends across the full width of the means. The pivotability mentioned is required in order to prevent the leading end 7', often curved upwardly, of an approaching slab 7 from running up against the rigid trough arrangement which, instead, can swing out of the way, as illustrated in FIG. 7. The trough is roof-shaped starting from the middle so that any accumulated spraying water can drain towards both sides (in planes perpendicular to the plane of the drawing), at the same time, entraining the scale particles caught. This rinsing effect can be improved still further by water or pressure air nozzles 44 formed in the bottom of the depression 43.

In similar manner, a trough arrangement 46 including a depression 47 and rinsing nozzles 48 is provided at the outlet side of the means and likewise is pivotable in counterclockwise sense about an axis 45 . At the outlet side, the figure shows in addition how split off scale particles impinge on the upper side surfaces of the trough where they are reflected towards the bottom of the trough in which they accumulate and are flushed out laterally in the same manner as with the trough arrangement 42 (see the dotted particle paths 51 and the arrows 52 indicating the trajectories of the reflected particles).

Part of the split off particles is deflected upwardly, as indicated by the upwardly curved particle paths 53. Particles which are deflected in this way are caught in lateral troughs 54, 55 which extend across the full width of the means and are fixed to the housing and likewise inclined in the fashion of roofs towards both sides. In this case, too, nozzles 56, 57 may be provided in the troughs for rinsing purposes.

Figure 8:
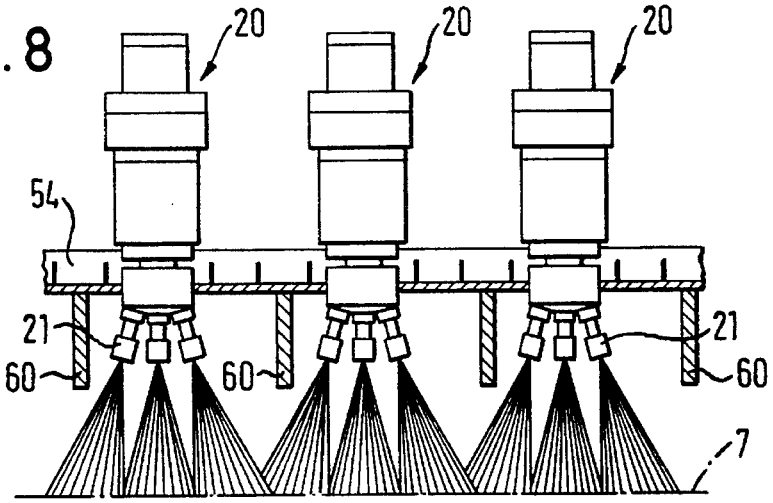
FIG. 8 is a part section of the structure shown in FIG. 7, as seen in the direction of line VIII—VIII in FIG. 7.

The walls of the housing 40 are not illustrated in the part sectional elevation of FIG. 8. FIG. 8 in addition shows webs 60 extending in longitudinal direction, i.e. in the direction of movement F (also to be seen in FIG. 7). Their lower ends project downwardly beyond the spray nozzles 21. If the rolled stock 7 should "bounce up" these webs prevent it from hitting the nozzles 21 and damaging them.

No such webs nor any scale collecting troughs are needed for the row of nozzles which is located in the housing 50 below the path of the workpiece because scale which bounces off the underside of the workpiece falls back down, in other words away from the workpiece surface.

Figure 10:
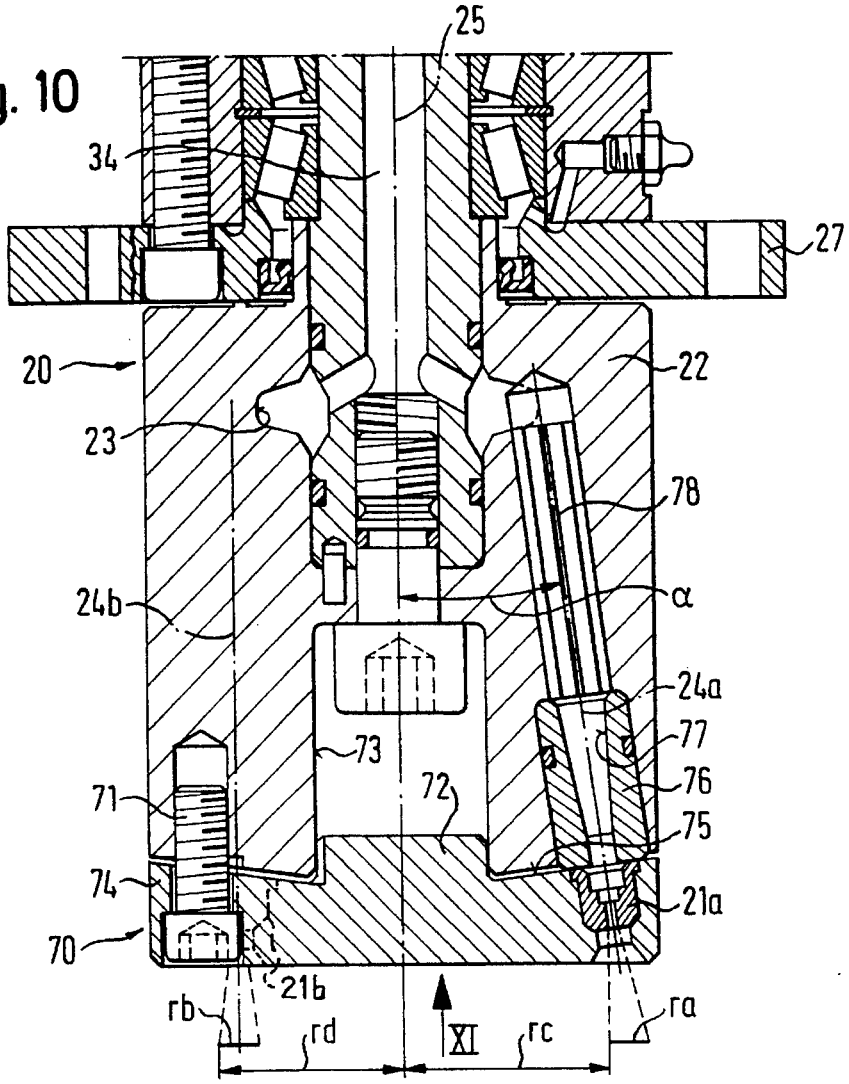
FIG. 10 is a sectional elevation similar to FIG. 9 through another concrete design of a nozzle head according to the invention along line X—X in FIG. 11.
Figure 11:
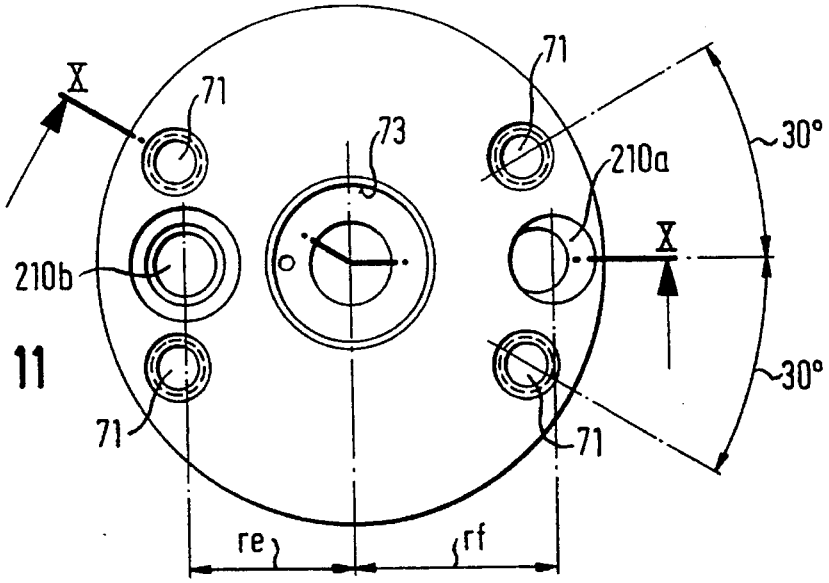
FIG. 11 is a view in the direction of arrow XI in FIG. 10, the cover of the nozzle head having been removed.

In the embodiment of a nozzle head illustrated in FIGS. 10 and 11 similar parts are designated by similar reference numerals without being described again.

The nozzle head 20 of the embodiment according to FIGS. 10 and 11 is provided with nozzles **21*a* and 21*b* which are offset with respect to the each other by 180° along the circumference. FIG. 10 shows merely one nozzle 21*a*, while the spray axis 24*b* alone of the other nozzle 21*b* is indicated, and the spray cone as well as a corresponding spray pattern, marked rb in FIG. 10, are illustrated in discontinuous lines outside of the spray head. The corresponding spray pattern in the same plane produced by nozzle 21*a* is marked ra. As may be gathered from FIG. 10, the spray axis 24*a* of nozzle 21*a* is inclined at an angle α of 15° with respect to the axis 25 of the nozzle head 20, whereas the spray axis 24*b* extends in parallel with the axis 25 of the nozzle head 20**.

While the drawing shows a configuration with which the distance rd measured from the radially outer end of the spray pattern rb to the axis 25 is smaller than the distance rc measured from the radially inner end of the spray pattern ra to the axis 25, the arrrangement preferably is made such that rc approximately equals rd. In that event the spray patterns ra and rb are directly contiguous in radial direction.

In a concrete embodiment, the arrangement is made such that the spray pattern rb extends radially inwardly almost up to the axis of rotation 25 of the nozzle head 20. In operation, that provides two radially contiguous (or, optionally, radially overlapping) spiral shaped spray patterns (cf. FIG. 6), with two spirals blending into each other in the case of the embodiment according to FIG. 10. This results in very uniform spraying and descaling because an inner free space such as is seen in FIG. 6 practically no longer exists with the preferred arrangement illustrated in FIGS. 10 and 11.

In the case of the embodiment according to FIG. 10 the nozzles 21 do not project away from the nozzle head 20, as with the embodiment shown in FIG. 9, instead they are integrated in a cover 70. Four screws 71 serve to fix this cover 70 to the nozzle head 20. The cover 70 has a central centering pin 72 engaging in a centering bore 73 formed in the nozzle head 20. Moreover, the cover 70 has an annular flange 74 with a flange surface 75 which is inclined inwardly towards the centering pin 72. The nozzle proper which is inserted from the inclined flange surface 75 in a bore formed in the cover **21*a* protrudes a little outwardly beyond the flange surface 75 so that upon tightening of the screws 71, of which two each flank the corresponding nozzle 21*a*, 21*b* between them (see FIG. 11), the nozzles 21*a*, 21*b* are pressed into tight sealing engagement against the face ends of cylinders 76. These cylinders 76 (FIG. 10 showing only cylinder 76 which belongs to nozzle 21*a*) include an inlet length 77 which tapers towards the nozzle 21*a* for pre-acceleration of the pressure water pumped to the nozzle. In per se known manner, flow straightening means 78 are provided between the ring duct 23 which distributes the pressure water and the cylinders 76 so as to straighten out the pressure water by means of channels oriented parallel to the spray axes 24*a*, 24*b* and conduct it through the cylinders 76 to the nozzles 21*a*, 21*b***.

In FIG. 11, of course, only those bores **210*a*, 210*b* which take up the nozzles as well as the centering bore 73 can be seen. It may be gathered from FIG. 11 that these bores are offset by 180° and, moreover, spaced from the axis of rotation of the nozzle head 20** at different radial distances rf, re.

Of course, the spray axis **24*b* also could be inclined with respect to the axis of rotation 25 of the nozzle head 20, or the spray axis 24*a* of the nozzle 21*a* could extend parallel to the axis of rotation 25**. What is important simply is that the spray patterns ra, rb are disposed radially offset with respect to each other. It will likewise be appreciated that more than two nozzles could be distributed along the periphery. They would then be arranged so that more than two radially offset spray patterns would be formed.

The embodiment according to FIGS. 10 and 11 assures especially uniform spraying of pressure water on the rolled stock and, therefore, involves very little consumption of water. The embodiment shown in FIGS. 10 and 11 is applied with particular advantage to descale especially continuously cast plates or sheets having relatively thin wall thicknesses.

What is claimed is:

1. A descaling apparatus for removing the scale layer on substantially flat surfaces of hot rolled stock linearly moved past a stationary descaler station, descaling being accomplished by spraying high pressure liquid on both sides of the rolled stock; the descaling apparatus comprising a plurality of nozzle heads (20) arranged in a row substantially transversely to the direction of movement of the hot rolled stock and at the same distance from the respective flat surface to be descaled, each nozzle head being mounted for rotation about an axis of rotation (25) substantially perpendicular to the flat surfaces of the hot rolled stock, and each nozzle head being provided with two nozzles (21*a*, 21*b*) disposed eccentrically with respect to the axis of rotation, the spray axis (24*a*) of one of the two nozzles being set at an acute angle (α) with respect to the axis of rotation (25*a*) of the nozzle head (20), and the spray axis (24*b*) of the other of the two nozzles (21*b*) extending parallel to the axis of rotation of the nozzle heads (20) so that their respective spray patterns in operation cover differing radial areas (ra, rb);

means for connecting each of said nozzles to a source of high pressure liquid; and means for rotating each nozzle head (20) about an axis of rotation (25) at an angular speed (r) of rotation with respect to the speed (v) of linear movement of the rolled stock so that the high pressure liquid impinges upon the substantially flat surface in overlapping spirals whereby a desired uniform average depth of removal of the scale layer over the width and length of the rolled stock is achieved.

2. The descaling apparatus as set forth in claim 1 wherein upper and lower parallel rows of nozzles heads (20) act upon the upper and lower sides of the hot rolled stock, the row of nozzle heads acting upon the upper side of the hot rolled stock (7) being arranged offset in the direction of motion (F) of the hot rolled stock with respect to the row of nozzle heads acting on the lower side.

3. The descaling apparatus as set forth in claim 1 wherein each nozzle projects a spray pattern in the form of a flattened ellipse (10), the long axis of the ellipse intersecting the axis of rotation (25).

* * * * *